US005713062A

United States Patent [19]

Goodman et al.

[11] Patent Number: 5,713,062

[45] Date of Patent: Jan. 27, 1998

[54] COLOR MIXING AND CONTROL SYSTEM FOR USE IN AN ELECTROSTATOGRAPHIC PRINTING MACHINE

[75] Inventors: Nancy B. Goodman, Webster; Thomas A. Henderson, Rochester, both of N.Y.

[73] Assignee: Xerox Corporation, Stamford, Conn.

[21] Appl. No.: 721,420

[22] Filed: Sep. 26, 1996

[51] Int. Cl.[6] ..... G03G 15/10

[52] U.S. Cl. ..... 399/49; 399/57; 399/223; 399/238; 430/117

[58] Field of Search ..... 399/49, 39, 54, 399/57, 72, 223, 228, 237, 238; 430/120, 117, 137; 347/43, 115

[56] References Cited

U.S. PATENT DOCUMENTS

| | | | |
|---|---|---|---|
| 3,852,088 | 12/1974 | Godlewski et al. | 399/130 X |
| 5,049,937 | 9/1991 | Takeda | 399/223 X |
| 5,240,806 | 8/1993 | Tang et al. | 430/115 |
| 5,369,476 | 11/1994 | Bowers et al. | 399/49 |
| 5,450,165 | 9/1995 | Henderson | 399/49 |
| 5,519,474 | 5/1996 | Arcaro et al. | 399/238 |
| 5,543,896 | 8/1996 | Lingappa | 399/49 |
| 5,557,393 | 9/1996 | Goodman et al. | 399/223 |
| 5,604,567 | 2/1997 | Dundas et al. | 399/39 |
| 5,623,715 | 4/1997 | Clark | 399/57 |

OTHER PUBLICATIONS

XDJ–vol. 21, No. 2. Mar./Apr. 1996 pp. 155–157 Entitled "Custom Color Liquid Ink Development" by Nancy B. Goodman.

*Primary Examiner*—Arthur T. Grimley
*Assistant Examiner*—Sophia S. Chen
*Attorney, Agent, or Firm*—Denis A. Robitaille

[57] ABSTRACT

A system and method for color mixing control in an electrostatographic printing system. An operative mixture of colored developing material is continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A colorimeter is provided for monitoring the color of a test image printed with the operative mixture of developing material in the supply reservoir so that the color thereof can be brought into agreement with a color required to produce the customer selectable output color. The present invention can be used to control and maintain the color of the operational mixture of developing material in the reservoir through continuous monitoring and correction in order to maintain a specified ratio of color components in the reservoir over extended periods associated with very long print runs. The present invention may also be utilized to mix a customer selectable color in situ, whereby approximate amounts of primary color components are initially deposited and mixed in the developing material reservoir and resultant images printed with the developing material mixture are continually monitored and adjusted until the mixture reaches a desired color output.

15 Claims, 1 Drawing Sheet

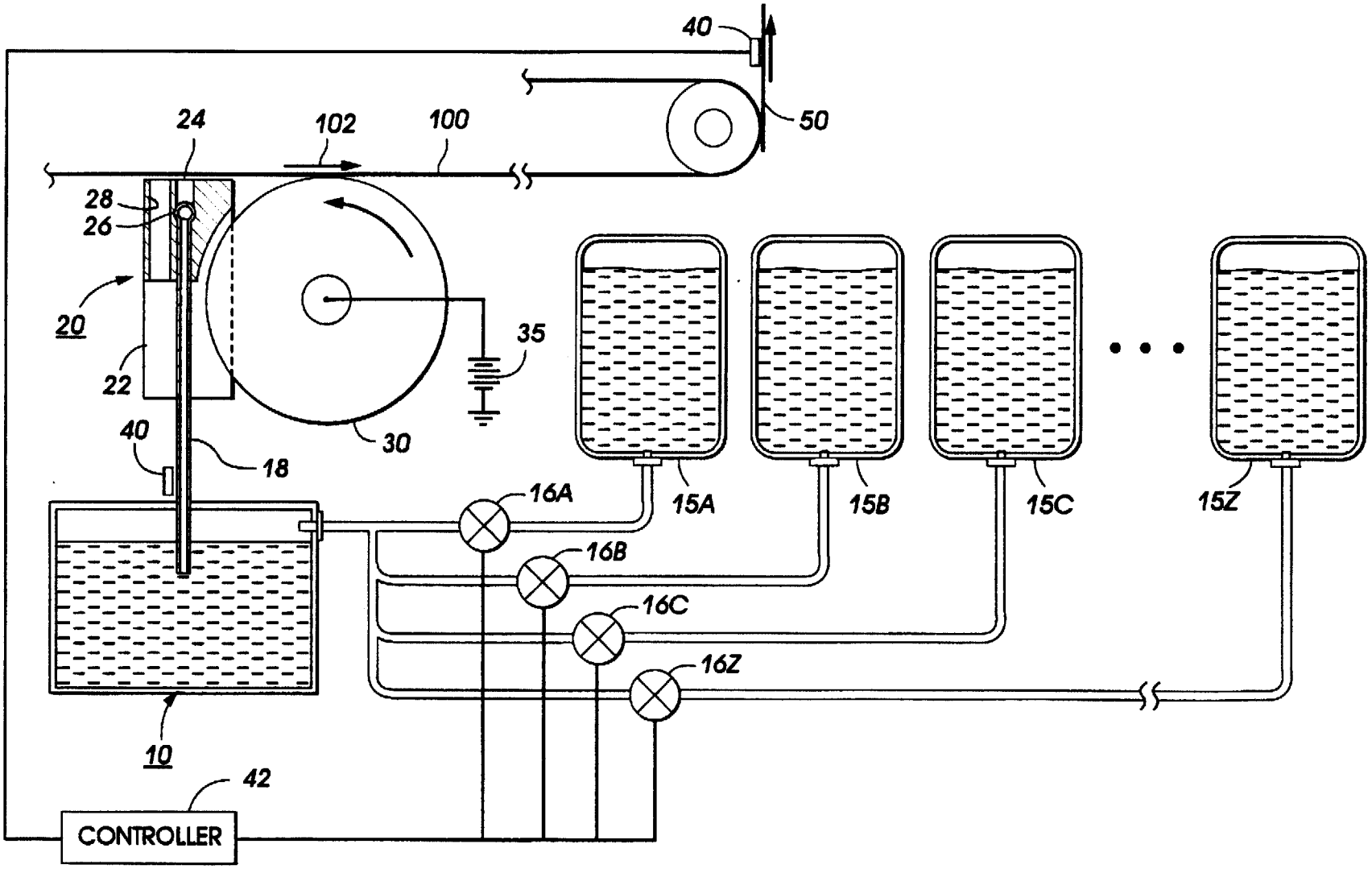
15Z
15C
15B
15A
16Z
16C
16B
16A
50
40
35
100
102
30
24
28
26
20
22
18
40
10
42
CONTROLLER

COLOR MIXING AND CONTROL SYSTEM FOR USE IN AN ELECTROSTATOGRAPHIC PRINTING MACHINE

This invention relates generally to a development system for creating highlight or spot color output images or for improving the color gamut of process color images in an electrostatographic printing machine. More specifically, the present invention concerns a system for providing customized, customer selectable color mixing and control thereof in an electrostatographic printing system using dry or liquid developing materials. The color mixing and control system operates by sensing the color output on a printed copy sheet to control the mixture of color components making up the developing material.

Generally, the process of electrostatographic copying and printing is initiated by exposing a light image of an original input document or signal onto a substantially uniformly charged photoreceptive member. Exposing the charged photoreceptive member to a light image discharges selective areas of the photoreceptive member, creating an electrostatic latent image on the photoreceptive member corresponding to the original input document or signal. This latent image is subsequently developed into a visible image by a process in which developing material is deposited onto the surface of the photoreceptive member. Typically, the developing material comprises carrier granules having toner particles adhering triboelectrically thereto, wherein the toner particles are electrostatically attracted from the carrier granules to the latent image to create a powder toner image on the photoreceptive member. Alternatively, liquid developing materials comprising pigmented marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are electrostatically attracted to the latent image to form a developed image and the developed image is subsequently transferred from the photoreceptive member to a copy substrate, either directly or via an intermediate transfer member. Once on the copy substrate, the image may be permanently affixed to provide a "hard copy" output document. In a final step, the photoreceptive member is cleaned to remove any charge and/or residual developing material from the photoconductive surface in preparation for subsequent imaging cycles.

The above-described electrostatographic reproduction process is well known and is useful for so-called light lens copying from an original document, as well as for printing of electronically generated or stored images where the electrostatic latent image is formed via a modulated laser beam. Analogous processes also exist in other printing applications such as, for example, ionographic printing and reproduction where charge is deposited in image configuration on a charge retentive surface (see, for example, U.S. Pat. No. 4,267,556 and U.S. Pat. No. 4,885,220, among numerous other patents and publications). Some of these printing processes, such as light lens generated image systems operate in a manner wherein the charged areas are developed (so-called CAD, or "write white" systems), while other printing processes operate in a manner such that discharged areas are developed (so-called DAD, or "write black" systems). It will be understood that the instant invention applies to all various types of electrostatographic printing systems and is not intended to be limited by the manner in which the image is formed or developed.

It is well known that conventional electrostatographic reproduction processes can be adapted to produce multicolor images. For example, the charged photoconductive member may be sequentially exposed to a series of color separated images corresponding to the primary colors in an input image in order to form a plurality of color separated latent images. Each color separated image is developed with a complimentary developing material containing a primary color or a colorant which is the subtractive compliment of the color separated image, with each developed color separated image subsequently superimposed, in registration, on one another to produce a multicolor image output. Thus, a multicolor image is generated from patterns of different primary colors or their subtractive compliments which are blended by the eye to create a visual perception of a color image.

This procedure of separating and superimposing color images produces so-called "process color" images, wherein each color separated image comprises an arrangement of picture elements, or pixels, corresponding to a spot to be developed with toner particles of a particular color. The multicolor image is a mosaic of different color pixels, wherein the color separations are laid down in the form of halftone dots. In halftone image processing, the dot densities of each of the color components making up the multicolor image can be altered to produce a large variation of color hues and shades. For example, lighter tints can be produced by reducing the dot densities such that a greater amount of white from the page surface remains uncovered to reflect light to the eye. Likewise, darker shades can be produced by increasing the dot densities. This method of generating process color images by overlapping halftones of different colors corresponding to the primary colors or their subtractive equivalents is well known in the art and will not be further described herein.

With the capabilities of electrostatographic technology moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing has been developed, wherein a printing system capable of producing process color output images is augmented with an additional developer housing containing an additional color beyond the primary or subtractive colors used to produce the process color output. This additional developer housing is used for developing an independent image with a specific color (spot color) or for extending the color gamut of the process color output (high fidelity color). As such, several concepts derived from conventional electrostatographic imaging techniques which were previously directed to monochrome and/or process color image formation have been modified to generate output images having selected areas that are different in color than the rest of the document. Applications of highlight, spot and high fidelity color include, for example, emphasis on important information, accentuation of titles, and more generally, differentiation of specific areas of text or other image information.

One exemplary highlight color process is described in U.S. Pat. No. 4,078,929 to Gundlach, wherein independent images are created using a raster output scanner to form a tri-level image including a pair of image areas having different potential values and a non-image background area generally having a potential value intermediate the two image areas. As disclosed therein, the charge pattern is developed with toner particles of first and second colors, where the toner particles of one of the colors are positively charged and the toner particles of the other color are negatively charged, therefore producing a highlight color image.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of "custom color", which specifically refers to registered proprietary colors, such as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area. Further, lines and text produced by halftone process color are very sensitive to misregistration of the multiple color images such that blurring, color variances, and other image quality defects may result.

As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof. This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions which have been mixed together to produce a customer selectable color output.

Customer selectable color printing materials including paints, printing inks and developing materials can be manufactured by determining precise amounts of constituent basic color components making up a given customer selectable color material, providing precisely measured amounts of each constituent basic color component, and thoroughly mixing these color components. This process is commonly facilitated by reference to a color guide or swatch book containing hundreds or even thousands of swatches illustrating different colors, wherein each color swatch is associated with a specific formulation of colorants. Probably the most popular o these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the Pantone® system or other color formula guides of this nature that cannot be produced via typical halftone process color methods or even from mixing selected amounts of cyan, magenta, yellow and/or black inks or developer materials.

In the typical operational environment, an electrostatographic printing system may be used to print various customer selectable color documents. To that end, replaceable containers of premixed customer selectable color developing materials corresponding to each customer selectable color are provided for each print job. Replacement of the premixed customer selectable color developer materials or substitution of another premixed color between different print jobs necessitates operator intervention which typically requires manual labor and machine downtime, among other undesirable requirements. In addition, since each customer selectable color is typically manufactured at an off-site location, supplies of each customer selectable color printing ink must be separately stored for each customer selectable color print job.

Previously referenced U.S. Pat. No. 5,557,393, hereby incorporated by reference into the present application, discloses that it is desirable to provide an electrostatographic printing system with the capability of easily generating various customer selectable color output prints, in particular customer selectable color highlight color prints, wherein the developing material utilized to generate the customer selectable color output is formed of a mixture of at least two different basic color components provided in particular predetermined ratios. That patent application also discloses that it is desirable to provide an electrostatographic imaging process, wherein two or more color developing materials are dispensed from separate dispensers and are blended in a developing step for developing a latent image with a developer material including a blend of two or more color toner compositions.

The patent literature is replete with control systems for controlling electrostatographic processing parameters in response to the quality of the image produced by means of maintaining a test image or patch. For example, it is now common practice to provide a scanning device to sense optical density on other characteristics of a development test patch in order to generate a control response signal to adjust machine operation for print quality. Public demand for increased color quality and selectability has necessitated the development of various solutions and control mechanisms in response to particular requirements.

In a typical liquid developing material-based electrostatographic system, a liquid developing material reservoir is continuously replenished by the addition of various components making up the liquid developing material: namely liquid carrier, charge director, and a concentrated dispersion of toner particles in the carrier liquid, as necessary. This replenishment must be constantly monitored and controlled to provide a predetermined concentration of toner particles, liquid carrier, and charge director in the liquid developing material reservoir. The present invention builds on that concept by providing a system in which the color value of a developed customer selectable color image is monitored to control the rate of replenishment of various basic color components used to produce the customer selectable color developing material, thereby varying the concentration levels of each of the basic color components making up the customer selectable color developing material mixture in an operative developing material supply reservoir. Thus, the present invention contemplates a development system including a color mixing and control system, wherein the color value of the developing material in a supply reservoir can be controlled and the rate of replenishment of various color components added to the supply reservoir can be selectively varied. By adding and mixing precise amounts of specific color developing materials from a set of basic color components, the actual color of the developing material in the reservoir can be made to correspond with that required to print a predetermined selected output color. Moreover, by monitoring the output color of an image produced by the mixed developing materials, and controlling the replenishment process in response thereto, a wide range of customer selectable color liquid developing materials can be produced and maintained over very long print runs.

The following disclosures may be relevant to some aspects of the present invention:

U.S. Pat. No. 5,557,393

Patentee: Goodman et al.

Issued: Sep. 17, 1996

U.S. Pat. No. 5,543,896

Patentee: Mestha

Issued: Aug. 6, 1996

U.S. Pat. No. 5,450,165

Patentee: Henderson

Issued: Sep. 12, 1995

U.S. Pat. No. 5,369,476

Patentee: Bowers et al.

Issued: Nov. 29, 1994

U.S. Pat. No. 5,240,806

Patentee: Tang et. al.

Issued: Aug. 31, 1993

Xerox Disclosure Journal, Vol. 21, No. 2, pp. 155–157

Author: Goodman

Published: March/April 1996

The relevant portions of the foregoing patents may be briefly summarized as follows:

U.S. Pat. No. 5,557,393 discloses an electrostatographic imaging process including the formation of an electrostatic latent image on an image forming device, developing the electrostatic latent image on the image forming device with at least one developer containing carrier particles and a blend of two of more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process. U.S. Pat. No. 5,543,896 discloses a method for measurement of tone reproduction curves using a single structured patch for providing development control by storing a reference tone reproduction curve and providing a single test pattern including a scale of pixel values in an interdocument zone on a photoreceptor surface. The test pattern is sensed in the interdocument zone and a control response to the sensing of the test pattern is provided with reference to the tone reproduction curve in order to adjust the machine operation for print quality correction.

U.S. Pat. No. 5,450,165, the disclosure of which is incorporated by reference herein, discloses a method and system for identifying areas in pre-existing image data as test patches for print quality measurement in a printing apparatus. Incoming digital input data is polled for image data corresponding to a preselected density condition, such as a particular halftone, on an area of the final image. The area having the preselected density condition can be used as a test patch to monitor overall print quality.

U.S. Pat. No. 5,369,476 discloses a toner control system and method for electrographic printing in which toner is delivered from a reservoir to a toner fountain for application to an electrostatically charged sheet to form an image. The visual quality of the image is monitored, and toner concentrate is added to the toner in response to the monitored quality to increase the amount of pigment particles in the toner and to thereby maintain a substantially constant image quality. In the disclosed embodiments, a test image is formed outside the main image on the sheet, and the brightness of one or more predetermined colors in the test image is monitored.

U.S. Pat. No. 5,240,806 discloses a liquid color toner composition for use in contact and gap electrostatic transfer processes, wherein the toner comprises a colored predispersion including: a non-polymeric resin material having certain insolubility (and non-swellability), melting point, and acid number characteristics; and alkoxylated alcohol having certain insolubility (and non-swellability) and melting point characteristics; and colorant material having certain particle size characteristics. The toner further comprises an aliphatic hydrocarbon liquid carrier having certain conductivity, dielectric constant, and flash point.

Xerox Disclosure Journal, Vol. 21, No. 2, pp. 155–157 discloses customer selectable color liquid ink development and a customer selectable color liquid ink development process wherein two or more liquid colored inks are applied simultaneously, in proper predetermined relative amounts, to provide custom or customer specified color images. The processes comprise, for example, providing a liquid development apparatus with at least one developer housing containing a liquid developer comprised of at least two different colored inks that are premixed at a desired concentration ratio, and developing a latent image with the premixed liquid developer to afford customer selectable colored developed images.

In accordance with one aspect of the present invention, there is provided an apparatus for developing an electrostatic latent image with a developing material having a color capable of providing an output print having a specified color. This developing apparatus comprises: a plurality of developing material supply dispensers, each containing a differently colored developing material concentrate corresponding to a basic color component making up the specified color; a developing material reservoir, for providing an operative supply of developing material for developing the electrostatic latent image so as to generate the output print of a specified color the reservoir having each of the developing material supply dispensers coupled thereto; and a system for systematically dispensing a selected amount of developing material concentrate from at least a selected one of the developing material supply dispensers to the developing material reservoir to provide a selected amount of a selected basic color component to the operative supply of developing material.

In accordance with another aspect of the present invention, an electrostatographic printing apparatus is provided including at least one development subsystem for developing at least a portion of an electrostatic latent image with a developing material having a color required to provide an output print having a specified color. The development subsystem comprises: a plurality of developing material supply dispensers, each containing a differently colored developing material concentrate corresponding to a basic color component; a developing material reservoir for providing an operative supply of developing material for developing the electrostatic latent image so as to generate the output print having a specified color, the reservoir having each of the developing material supply dispensers coupled thereto; and a system for systematically dispensing a selected amount of developing material concentrate from at least a selected one of the developing material supply dispensers to the developing material reservoir to provide a selected amount of a selected basic color component to the operative supply of developing material.

In accordance with another aspect of the present invention, an electrostatographic printing process is provided, wherein at least a portion of an electrostatic latent image is developed with a developing material having a color necessary to produce an output print having a specified color. The process comprises the steps of: providing a plurality of differently colored developing concentrate materials corresponding to a plurality of basic color components which can be mixed to create a customer selectable color output print; providing a developing material reservoir for mixing a plurality of the differently colored concentrated developing materials; and systematically dispensing a selected amount of developing material concentrate of a selected basic color component to the developing material reservoir for providing a selected basic color component to the operative supply of developing material.

In accordance with yet another aspect of the present invention, a system for providing a customer selectable color image area in the output print of an electrostatographic printing machine is provided. The system includes a plurality of developing material supply dispensers, each containing a differently colored developing material concentrate corresponding to a basic color component of a color matching system for producing the customer selectable color image area in the output print; a developing material reservoir having each of the developing supply receptacles coupled thereto, for providing a supply of operative developing material; and a system for systematically dispensing a selected amount of developing material concentrate from at least a selected one of the developing material supply dispensers to the developing reservoir to provide a selected basic color component to the supply of operative liquid developing material.

Other aspects of the present invention will become apparent as the following description proceeds and upon reference to the FIGURE, which provides a schematic, elevational view of an exemplary liquid developing material applicator and an exemplary liquid developing material development system incorporating a liquid developing material color mixing and control system in accordance with the present invention. While the present invention will be described with respect to a liquid developing apparatus, it will be understood that the mixing and control system of the present invention is not limited to liquid developing materials and may be utilized in dry powder electrostatographic applications as well as liquid electrostatographic applications.

Since the art of electrostatographic printing is well known, it is noted that several concepts for electrostatographic highlight, spot and/or high fidelity color imaging systems which could make beneficial use of the color mixing and control system of the present invention have been disclosed in the relevant patent literature. One of the more elegant and practical of these concepts is directed toward single-pass highlight color tri-level imaging. In general, tri-level imaging involves the creation of two different electrostatic latent images at different voltage levels generated in a single imaging step, with a background or non-image area at yet another intermediate voltage level. Typically, one latent image is developed using charged-area development (CAD) techniques, while the other is developed via discharged-area development (DAD) techniques. This is accomplished by using positively charged toner for one color and negatively charged developing materials for the other, in separate housings. For example, by providing one developing material in black and the other in a selected color for highlighting, two different color images can be created on a single output document in a single processing cycle. This concept for tri-level xerography, is disclosed in U.S. Pat. No. 4,078,929, issued in the name of Gundlach, incorporated by reference herein. As disclosed therein, tri-level xerography involves the modification of known xerographic processes, such that the xerographic contrast on the charge retentive surface or photoreceptor is divided three ways, rather than two, as in the case in conventional xerography. Thus the photoreceptor is imagewise exposed such that one image, corresponding to charged image areas, is maintained at the full photoreceptor potential ($V_{ddp}$ or $V_{cad}$) while the other image, which corresponds to discharged image areas is exposed to discharge the photoreceptor to its residual potential, i.e. $V_{dad}$. The background areas are formed by exposing areas of the photoreceptor at $V_{ddp}$ to reduce the photoreceptor potential to halfway between the $V_{cad}$ and $V_{dad}$ potentials, and is referred to as $V_w$ or $V_{white}$.

While the present invention may find particular application in tri-level highlight color imaging, it will become apparent from the following discussion that the color mixing and control system of the present invention may be equally well-suited for use in a wide variety of printing machines and is not necessarily limited in its application to the particular single-pass highlight tri-level electrostatographic process described by Gundlach. In fact, it is intended that the color mixing and control system of the present invention may be extended to any electrostatographic printing process intended to produce a customer selectable color image area including multi-color printing machines which may be provided with an ancillary customer selectable color development housing, as well as printing machines which carry out ionographic printing processes and the like. More generally, while the color mixing and control system of the present invention will hereinafter be described in connection with one of numerous various embodiments thereof, it will be understood that the description of the invention is not intended to limit the scope of the present invention to this preferred embodiment. On the contrary, the present invention is intended to cover all alternatives, modifications, and equivalents as may be included within the spirit and scope of the invention as defined by the appended claims.

Turning now to the FIGURE, an exemplary apparatus for developing an electrostatic latent image, wherein liquid developing materials are utilized is depicted in schematic form. Typically, a highlight color electrostatographic printing machine would include at least two developing apparatus operating with different color liquid developing materials for developing latent image areas into different colored visible images. By way of example, in a tri-level system of the type described hereinabove, a first developer apparatus might be utilized to develop the positively charged image area with black colored liquid developing material, while a second developer apparatus might be used to develop the negatively charged image area image with a customized color. In the case of liquid developing materials, each different color developing material comprises pigmented toner or marking particles, as well as, charge control additives and charge directors, all disseminated through a liquid carrier, wherein the marking particles are charged to a polarity opposite in polarity to the charged latent image to be developed.

The developing apparatus of the FIGURE operates primarily to transport liquid developer material into contact with a latent image on a photoreceptor surface, generally identified by reference numeral 100, wherein the marking particles are attracted, via electrophoresis, to the electrostatic latent image for creating a visible developed image thereof. With respect to the developing material transport and application process, the basic manner of operation of each developer apparatus is generally identical to one another and the developing apparatus shown in the FIGURE represents only one of various known apparatus that can be utilized to apply liquid developing material to the photoconductive surface. It will be understood that the basic development system incorporating the mixing and control system of the present invention may be directed to liquid or dry powder development, and may take many forms, as for example, systems described in U.S. Pat. Nos. 3,357,402; 3,618,552; 4,733,273; 4,883,018; 5,270,782 and 5,355,201 among numerous others. Such development systems may be utilized in a multicolor electrophotographic printing machine, a highlight color machine, or in a monochromatic printing machine. In general, the only distinction between each developer unit is the color of the liquid developing material therein. It will be recognized, however, that only developer applicators which require the capability of generating customer selectable color outputs will be provided with the customer selectable color mixing and control system of the present invention.

Focusing on the development process before describing the color mixing and control system of the present invention, in the exemplary developing apparatus of the FIGURE liquid developing material is transported from an supply reservoir 10 to the latent image on the photoreceptor 100 via a liquid developing material applicator 20. Supply reservoir 10 acts as a holding receptacle for providing an operative solution of liquid developing material comprised of liquid carrier, a charge director compound, and toner material, which, in the case of the customer selectable color application of the present invention, includes a blend of different colored marking particles. In accordance with the present invention, a plurality of replaceable supply dispensers 15A–15Z, each containing a concentrated supply of marking particles and carrier liquid corresponding to a basic color component in a color matching system, are provided in association with the operational supply reservoir 10 and coupled thereto for replenishing the liquid developing material therein, as will be described.

The exemplary developing material applicator 20 includes a housing 22, having an elongated aperture 24 extending along a longitudinal axis thereof so as to be oriented substantially transverse to the surface of photoreceptor 100, along the direction of travel thereof (as indicated by arrow 102). The aperture 24 is coupled to an inlet port 26 which is further coupled to reservoir 10 via transport conduit 18. Transport conduit 18 operates in conjunction with aperture 24 to provide a path of travel for liquid developing material being transported from reservoir 10 and also defines a developing material application region in which the liquid developing material can freely flow in order to contact the surface of the photoreceptor belt 100 for developing the latent image thereon. Thus, liquid developing material is pumped or otherwise transported from the supply reservoir 10 to the applicator 20 through at least one inlet port 26, such that the liquid developing material flows out of the elongated aperture 24 and into contact with the surface of photoreceptor belt 100. An overflow drainage channel (not shown), partially surrounds the aperture 24, may also be provided for collecting excess developing material which may not be transferred over to the photoreceptor surface during development. Such an overflow channel would be connected to an outlet channel 28 for removal of excess or extraneous liquid developing material and, preferably, for directing this excess material back to reservoir 10 or to a waste sump whereat the liquid developing material can preferably be collected and the individual components thereof can be recycled for subsequent use.

Slightly downstream of and adjacent to the developing material applicator 20, in the direction of movement of the photoreceptor surface 100, is an electrically biased metering or developer roll 30 (also referred to as a developing roll or developing roller herein), the peripheral surface thereof being situated in close proximity to the surface of the photoreceptor 100. The developer roller 30 rotates in a direction opposite the movement of the photoconductor surface 100 so as to apply a substantial shear force to the thin layer of liquid developing material present in the area of the nip between the developer roller 30 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 20. The excess developing material eventually falls away from the rotating metering roll for collection in the reservoir 10 or a waste sump (not shown). A DC power supply 35 is also provided for maintaining an electrical bias on the metering roll 30 at a selected polarity such that image areas of the electrostatic latent image on the photoconductive surface will attract marking particles from the developing material for developing the electrostatic latent image. This electrophoretic development process minimizes the existence of marking particles in background regions and maximizes the deposit of marking particles in image areas on the photoreceptor.

In operation, liquid developing material is transported in the direction of the photoreceptor 100, filling the gap between the surface of the photoreceptor and the liquid developing material applicator 20. As the belt 100 moves in the direction of arrow 102, a portion of the liquid developing material in contact with the photoreceptor moves therewith toward the developing roll 30 where marking particles in the liquid developer material are attracted to the electrostatic latent image areas on the photoreceptor. The developing roller 30 also meters a predetermined amount of liquid developing material adhering to the photoconductive surface of belt 100 and acts as a seal for transporting extraneous liquid developing material away from the photoreceptor.

As previously indicated, the liquid developing materials of the type suitable for electrostatographic printing applications generally comprise marking particles and charge directors dispersed in a liquid carrier medium, with an operative solution of the developing material being stored in reservoir 10. Generally, the liquid carrier medium is present in a large amount in the liquid developing material composition, and constitutes that percentage by weight of the developer not accounted for by the other components. The liquid medium is usually present in an amount of from about 80 to about 99.5 percent by weight, although this amount may vary from this range provided that the objectives of the present invention can be achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar®15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol® available from Mobil Oil Corporation, Shellsol®, available from Shell Oil Company, and the like. Isoparaffinic hydrocarbons provide a preferred liquid media, since they are colorless, and environmentally safe. These particular hydrocarbons may also possess a sufficiently high vapor pressure so that a thin film of the liquid evaporates from the contacting surface within seconds at ambient temperatures.

The marking or so-called toner particles of the liquid developing material can comprise any particle material compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in the operative liquid developing material in amounts of from about 0.5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone.

Examples of thermoplastic resins include ethylene vinyl acetate (EVA) copolymers, (ELVAX® resins, E.I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURALÔ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an a-b-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

In embodiments, the marking particles are comprised of thermoplastic resin, a charge adjuvant (a term which is used to encompass charge control additives, charge directors, and the like), and the pigment. Therefore, it is important that the thermoplastic resin and the charge adjuvant be sufficiently compatible that they do not form separate particles, and that the charge adjuvant be insoluble in the hydrocarbon liquid carrier to the extent that no more than 0.1 weight percent be soluble therein. The charge director mixture of phosphate ester and aluminum complex can be selected for the liquid developers in various effective amounts, such as, for example, in embodiments from about 1 to 1,000 milligrams of charge director per gram of toner solids and preferably 10 to 100 milligrams/gram. Developer solids include toner resin, pigment, and optional charge adjuvant.

Liquid developing materials preferably contain a colorant dispersed in the resin particles. Colorants, such as pigments or dyes like black, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible. The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK®, PV FAST BLUE®, and Paliotol Yellow D1155; as well as the numerous pigments listed and illustrated in U.S. Pat. Nos. 5,223,368; 5,484,670, the disclosures of which is totally incorporated herein by reference; and the following:

As previously discussed, in addition to the liquid carrier vehicle and toner particles which typically make up the liquid developer materials, a charge director compound (sometimes referred to as a charge control additive) is also provided for facilitating and maintaining a uniform charge on the marking particles in the operative solution of the liquid developing material by imparting an electrical charge of selected polarity (positive or negative) to the marking particles.

Examples of suitable charge director compounds and charge control additives include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The use of quarternary charge directors as disclosed in the patent literature may also be desirable. The charge control additive may be present in an amount of from about 0.01 to about 3 percent by weight, and preferably from about 0.02 to about 0.05 percent solids by weight of the developer composition.

The application of developing material to the photoconductive surface clearly depletes the overall amount of the operative solution of developing material in supply reservoir 10. In the case of the liquid developing materials, marking particles are depleted in the image areas; carrier liquid is depleted in the image areas (trapped by marking particles) and in background areas, and may also be depleted by evaporation; and charge director is depleted in the image areas (trapped in the carrier liquid), in the image areas adsorbed onto marking particles, and in the background areas. In general practice, therefore, reservoir 10 is continuously replenished, as necessary, by the addition of developing material or selective components thereof, for example in the case of liquid developing materials, by the addition of liquid carrier, marking particles, and/or charge director into the supply reservoir 10. Since the total amount of any one component making up the developing material utilized to develop the image may vary as a function of the area of the developed image areas and the background portions of the latent image on the photoconductive surface, the specific amount of each of each component of the liquid developing material which must be added to the supply reservoir 10 varies with each development cycle. For example, a developed image having a large proportion of printed image area will cause a greater depletion of marking particles and/or charge director from a developing material reservoir as compared to a developed image with a small amount of printed image area.

Thus, it is known in the art that, while the rate of replenishment of the liquid carrier component of the liquid developing material may be controlled by simply monitoring the level of liquid developer in the supply reservoir 10, the rate of replenishment of the marking particles, and/or the charge director components of the liquid developing material in reservoir 10 must be controlled in a more sophisticated manner to maintain a the correct concentration for proper functionality of the marking particles and the charge director in the operative solution stored in the supply reservoir 10 (although that concentration may vary with time due to changes in operational parameters). Systems have been disclosed in the patent literature and otherwise for systematically replenishing individual components making up the liquid developing material (liquid carrier, marking particles and/or charge director) as they are depleted from the reservoir 10 during the development process. See, for example, commonly assigned U.S. patent application Ser. No. 08/551,381 and the references cited therein.

The present invention, however, contemplates a liquid developing material replenishing system capable of systematically replenishing individual color components making up a customer selectable color liquid developing material composition. As such, the replenishment system of the present invention includes a plurality of differently colored developing material supply dispensers 15A, 15B, 15C, . . . 15Z, each coupled to the operative supply reservoir via a respective associated valve member 16A, 16B 16C . . . 16Z, or other appropriate liquid flow control device. Preferably, each supply dispenser contains a developing material concentrate of a known basic or primary color such as Cyan, Magenta, Yellow and Black. In one specific embodiment, the replenishment system includes eighteen supply dispensers, wherein each supply container provides a different basic color liquid developing material corresponding to the eighteen basic or constituent colors of the Pantone® Color Matching System. This embodiment contemplates that color formulations conveniently provided by the Pantone® System can be utilized, as for example, by storage in a look up table, to produce thousands of desirable output colors and shades in a customer selectable color printing. Using this system, as few as two different color liquid developing materials, from supply containers 15A and 15B for example, can be combined in reservoir 10 to expand the color gamut of customer selectable colors far beyond the colors available via half tone imaging techniques.

An essential component of the liquid developing material color mixing and control system of the present invention is a color control system. That is, since different components of the blended liquid developing material in reservoir 10 may develop at different rates, a customer selectable color mixing controller 42 is provided in order to determine appropriate amounts of each color liquid developing material in supply containers 15A, 15B . . . or 15Z to be added to supply reservoir 10, and to controllably supply each of such appropriate amounts of liquid developing material. Controller 42 may take the form of any known microprocessor based memory and processing device, as are well known in the art.

The approach provided by the color mixing control system of the present invention includes a sensing device 40, for example an optical sensor for monitoring the output color of the image transferred to the output copy substrate 50. Sensor 40 is connected to controller 42 for providing sensed color information thereto, which, in turn is used for controlling the flow of the variously colored replenishing liquid developing materials from dispensers 15A–15Z. The colored developing materials in dispensers 15A–15Z correspond to the basic constituent colors of a color matching system, and are selectively delivered into the liquid developing material supply reservoir 10 from each of the supply containers 15A–15Z to produce the customer selectable color output image. In a preferred embodiment, as shown in the FIGURE, the controller 42 is coupled to control valves 16A–16Z for selective actuation thereof to control the flow of liquid developing material from each supply container 15A–15Z. It will be understood that these valves may be replaced by pump devices or any other suitable flow control mechanisms as known in the art, so as to be substituted thereby.

In the preferred embodiment of the present invention, color accuracy is maintained by monitoring and sensing the color of a test image, formed on a final output substrate 50, typically printed as a test sheet which may be purged from the printing system and subsequently discarded. Alternatively, an area identified in an image as corresponding to the customer selectable color may be monitored and sensed in a manner similar to the process disclosed in U.S. Pat. No. 5,450,165, incorporated by reference herein, so as to obviate the need for the printing of a test image. Monitoring of the color output image for color accuracy can be facilitated by a sensor 40 such as a colorimeter of the type known in the art utilizing any technique for measuring color. Sensor 40, senses the actual color of the test image, and in turn, provides an image feedback signal to controller 42, the signal being processed by conventional electronic circuitry in order to selectively control the operation of valves 16A–16Z. In order to maintain precise color control, each selected developing material concentrate is preferably dispensed in a relatively small amount into the reservoir 10 where it is thoroughly mixed with the developing material therein to produce the desired customer selectable color developing material.

While sensor 40 can take various forms and could be of many types as are well known in the art, the preferred embodiment of the present invention includes a colorimeter for sensing the color of an output image on a final output substrate. Using an exemplary colorimeter, a developed and transferred test image on a copy substrate is illuminated with a collimated beam of light from an infrared light emitting diode (LED) or other light source, with the reflected light being measured to define the color of the test image.

The color is typically defined in terms of a particular color coordinate system, such as, for example, the well recognized standardized color notation system for defining uniform color spaces developed by the Commission Internationale de l'Eclairage (CIE). The CIE color specification system employs so called "tristimulus values" to specify colors and to establish device independent color spaces. The CIE standards are widely accepted because measured colors can be readily expressed in the CIE recommended coordinate systems through the use of relatively straight-forward mathematical transformations.

Once the color for a monitored test image is determined, the color of the measured sample is compared to the known values corresponding to the desired output color (as may be provided by the color matching system) to determine the precise color formulation necessary making up the supply of operative developing material in reservoir 10 to yield a correct color match on the output image. This information is processed by controller 42 for selectively actuating valves 16–16Z to systematically dispense to the reservoir 10 selective amounts of liquid developing material concentrate corresponding to selected basic color components from selected supply dispensers 15A–15Z.

In an exemplary embodiment for implementing the present invention, the required concentration levels of each basic color component required to generate any given color may be stored in a look up table in processor 42. The measured color of a test image is transformed into its tristimulus values and compared to the tristimulus values of the desired output color. The differential result of this comparison is then transformed to provide the precise amounts of each basic color component necessary to modify the operative supply of developing material to yield the desired output color.

In sum, the measured color output from the colorimeter is used to provide the relative corrections of each basic color component necessary to produce a desired output color. The relative concentrations of each color component necessary to produce a given customer selectable color may be provided, for example, by use of the Pantone® color matching system, to provide a determination of color components which must be added to the reservoir 10. As previously indicated, this function is carried out via controller 42 which selectively actuates valves 16A–16Z to dispense particular basic color components in relatively small amounts to the reservoir 10. Color quality is maintained by continuously monitoring test patches and controlling the basic color development dispensing process accordingly.

In review, the present invention provides a system and method for color mixing control in a liquid developing material-based electrostatographic printing system. A developing reservoir containing an operative solution of customer selectable color developing material is continuously replenished with the basic color components thereof, the color being controlled and maintained by selectively varying the rate of replenishment of various color components added to the supply reservoir. A colorimeter is used to monitor the color of a test image on an output copy substrate so that the actual color thereof can be brought into agreement with a target color value. The present invention can be used to control and maintain the color of the developing material in the reservoir through continuous monitoring of the test images and correction of the liquid developing material components in order to maintain a particular ratio of color components in the reservoir over extended periods associated with very long print runs. The present invention may also be utilized to mix a customer selectable color in situ, whereby approximate amounts of primary color components are initially deposited and mixed in the liquid developing material reservoir, this developing material mixture being used to produce a printed test image, with each test image being monitored and the color components making up the developing material adjusted until the mixture reaches a target color value.

It is, therefore, evident that there has been provided, in accordance with the present invention a color mixing control and replenishment system that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An apparatus for developing an electrostatic latent image with a developing material having a color required to provide an output print of a specified color, comprising:

a plurality of developing material supply dispensers, each containing a differently colored developing material concentrate corresponding to a basic color component making up the specified color;

a developing material reservoir for providing an operative supply of developing material for developing the electrostatic latent image so as to generate the output print of a specified color, said reservoir having each of said developing material supply dispensers coupled thereto;

a system for systematically dispensing a selected amount of developing material concentrate from at least a selected one of said developing material supply dispensers to said developing material reservoir in order to provide a selected amount of a selected basic color component to said supply of operative developing material;

a color sensing device for monitoring the color of a test image printed on a copy substrate with said operative supply of developing material; and a control system coupled to said color sensing device for selectively actuating said systematic dispensing system in response to the measured color of the test image, wherein said control system includes:

means for comparing the measured color of the test image against a color corresponding to the specified color;

means for providing a formulation representing relative concentrations of each of the color components necessary in said operative supply of developing material to produce a color output print having the specified color; and means, responsive to said comparing means and said formulation providing means, for determining selected amounts of selected color components for modifying the operative supply of developing material required to provide the specified color output.

2. The apparatus of claim 1, wherein said sensing device includes a colorimeter for measuring the color of the test image.

3. The apparatus of claim 1, further including at least one control valve coupled to each of said developing material supply dispensers, wherein said control system further includes means for actuating a selected control valve for dispensing a selected amount of developing material of a selected color component to said developing material reservoir.

4. The apparatus of claim 1, wherein said control system is operative to provide a customer selectable color developing material by blending a plurality of developing materials having different basic color components.

5. The apparatus of claim 1, further including a developing material applicator coupled to said developing material supply reservoir, adapted for transporting developing material into contact with the electrostatic latent image.

6. An electrostatographic printing apparatus including at least one development subsystem for developing at least a portion of an electrostatic latent image with a developing material having a color required to provide an output print of a specified color, said development subsystem comprising:

a plurality of developing material supply dispensers, each containing a differently colored developing material concentrate corresponding to a basic color component;

a developing material reservoir for providing an operative supply of developing material for developing the electrostatic latent image so as to generate the output print of a specified color, said reservoir having each of said developing material supply dispensers coupled thereto;

a system for systematically dispensing a selected amount of developing material concentrate from at least a selected one of said developing material supply dispensers to said developing material reservoir in order to provide a selected amount of a selected basic color component to said supply of operative developing material;

a color sensing device for monitoring the color of a test image printed on a copy substrate using said operative supply of developing material; and a control system coupled to said color sensing device for selectively actuating said systematic dispensing system, wherein said control system includes:

means for comparing the measured color of the test image against a color corresponding to the specified color;

means for providing a formulation representing relative concentrations of each of the color components necessary in said operative supply of developing material to produce a color output print having the specified color; and means, responsive to said comparing means and said formulation providing means, for determining selected amounts of selected color components for modifying the operative supply of developing material required to provide the specified color output.

7. The electrostatographic printing apparatus of claim 6, wherein said sensing includes a colorimeter for monitoring the color of the test image.

8. The apparatus of claim 6, further including at least one control valve coupled to each of said developing material supply dispensers, wherein said control system further includes means for actuating a selected control valve for dispensing a selected amount of developing material of a selected color component to said developing material reservoir.

9. The apparatus of claim 6, wherein said control system is operative to provide a customer selectable color developing material by blending a plurality of developing materials having different basic color components.

10. The electrostatographic printing apparatus of claim 6, further including a developing material applicator coupled to said developing material supply reservoir, adapted for transporting developing material into contact with the electrostatic latent image.

11. An electrostatographic printing process wherein at least a portion of an electrostatic latent image is developed with a developing material having a color necessary to produce an output print having a specified color, comprising the steps of:

providing a plurality of differently colored concentrate developing materials, each corresponding to basic color components which can be mixed with other basic color components to create a customer selectable color;

providing a developing material reservoir for mixing a plurality of the differently colored concentrate developing materials;

systematically dispensing a selected amount of developing material concentrate of a selected basic color component to said developing material reservoir for providing a selected basic color component to said operative supply of developing material;

measuring a color value of a test image printed on a copy substrate using said operative supply of developing material; and selectively actuating said systematic dispensing step in accordance with the following process steps comparing the measured color value of the test image against a color value corresponding to the specified color;

providing a formulation representing relative concentrations of each of the color components necessary in said operative supply of developing material to produce a color output print having the specified color; and determining, in response to said comparing and formulation providing steps, selected amounts of selected color components for modifying the operative supply of developing material required to provide the specified color output.

12. A system for providing a customer selectable color image area in an output print of an electrostatographic printing machine, comprising:

a plurality of developing material supply dispensers, each containing a differently colored developing material concentrate corresponding to a basic color component of a color matching system for producing the customer selectable color image area in the output print;

a developing material reservoir, for providing an operative supply of developing, said reservoir having each of said developing material supply dispensers coupled thereto;

a system for systematically dispensing a selected amount of developing material concentrate from at least a selected one of said developing material supply dispensers to said developing material reservoir to provide a selected basic color component to said operative supply of developing material;

a color sensing device for monitoring the color of a test image printed on a copy substrate using said operative supply of developing material; and a control system coupled to said color sensing device for selectively actuating said systematic dispensing system, wherein said control system includes means for comparing the measured color of the test image against a color corresponding to the specified color;

means for providing a formulation representing relative concentrations of each of the color components necessary in said operative supply of developing material to produce a color output print having the specified color; and means, responsive to said comparing means and said formulation providing means, for determining selected amounts of selected color components for modifying the operative supply of developing material required to provide the specified color output.

13. The apparatus of claim 12, wherein said sensing device includes a colorimeter for measuring the color of the test image.

14. The apparatus of claim 12, wherein the color matching system includes a Pantone® color matching system.

15. A system for systematically dispensing to an operative developing material supply reservoir a selected amount of developing material concentrate from at least a selected one of a plurality of developing material supply dispensers in order to provide a selected amount of developing material of a selected color component to said operative developing material supply reservoir so as to produce a specified color, comprising:

a color sensing device for measuring a color value in an image formed with said operative developing material supply reservoir;

a control system coupled to said color sensing device for selectively actuating said systematic dispensing system in response to the measured color of the test image, said control system including means for comparing the measured color value in the image the specified color;

means for providing a formulation representing relative concentrations of each color component necessary to produce a color output print of the specified color; and means, responsive to said comparing means and said formulation providing means, for determining selected amounts of selected color components for modifying the operative developing material supply reservoir necessary to provide the specified color as an output.

* * * * *